US005738315A

United States Patent [19]

Kent, Jr.

[11] Patent Number: 5,738,315

[45] Date of Patent: Apr. 14, 1998

[54] PORTABLE HOLDER FOR A REFUSE BAG

[76] Inventor: John E. Kent, Jr., 900 Siskiyou Blvd. #A-3, Medford, Oreg. 97504

[21] Appl. No.: 782,602

[22] Filed: Jan. 13, 1997

[51] Int. Cl.[6] ..... A63B 55/00

[52] U.S. Cl. ..... 248/97; 248/95; 248/99; 248/156

[58] Field of Search ..... 248/97, 94, 95, 248/99, 156

[56] References Cited

U.S. PATENT DOCUMENTS

| | | | |
|---|---|---|---|
| 2,100,235 | 11/1937 | Brown | 248/97 |
| 3,756,548 | 9/1973 | Santarelli et al. . | |
| 4,040,638 | 8/1977 | Flagg . | |
| 4,196,880 | 4/1980 | Hynes . | |
| 4,202,521 | 5/1980 | Harding . | |
| 4,601,315 | 7/1986 | France . | |
| 4,638,967 | 1/1987 | MacDuffee | 248/97 |
| 5,069,405 | 12/1991 | Keating . | |
| 5,360,189 | 11/1994 | Hart | 248/97 |
| 5,570,862 | 11/1996 | Nugent | 248/97 |

FOREIGN PATENT DOCUMENTS

| | | | |
|---|---|---|---|
| 2177996 | 2/1987 | United Kingdom | 248/97 |

*Primary Examiner*—Victor N. Sakran

*Attorney, Agent, or Firm*—Kolisch, Hartwell, Dickinson, McCormack & Heuser

[57] ABSTRACT

A lightweight and inexpensive refuse bag holder is provided, the holder including a simple perimeter structure formed from a C-shaped rod and a tube. The holder also may include a support structure connected to the perimeter structure to support the perimeter structure. The support structure may include sled runners which facilitate the user's dragging the holder along the ground during refuse collection. The support structure also may include appropriate spikes to permit anchoring of the holder in the ground.

17 Claims, 4 Drawing Sheets

Fig. 1
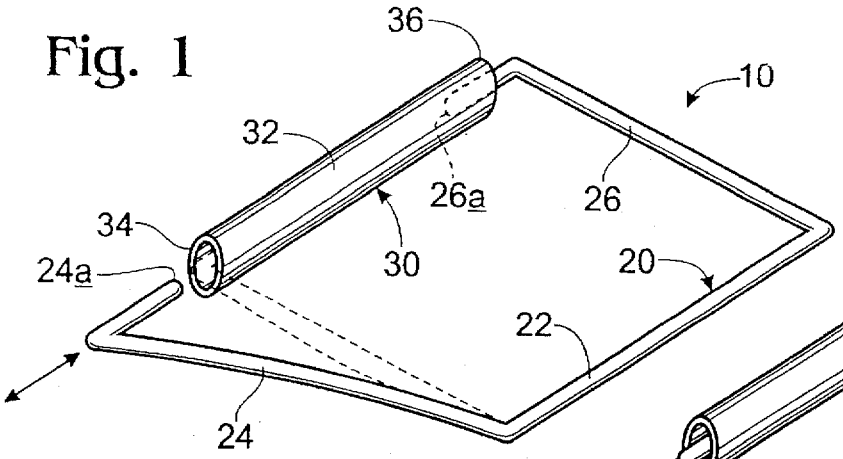
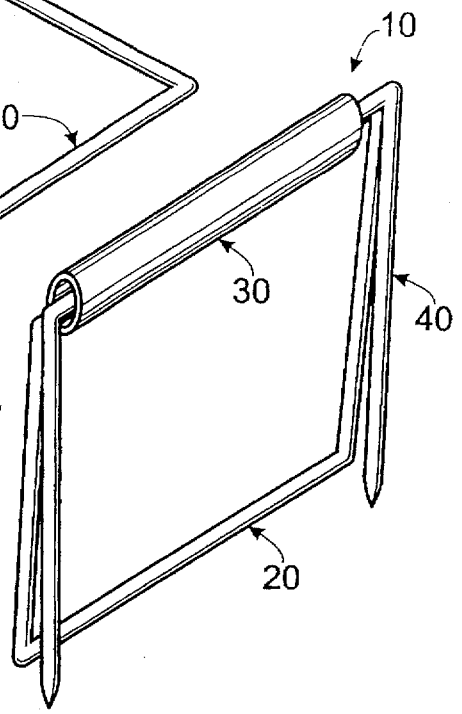
Fig. 4
Fig. 2
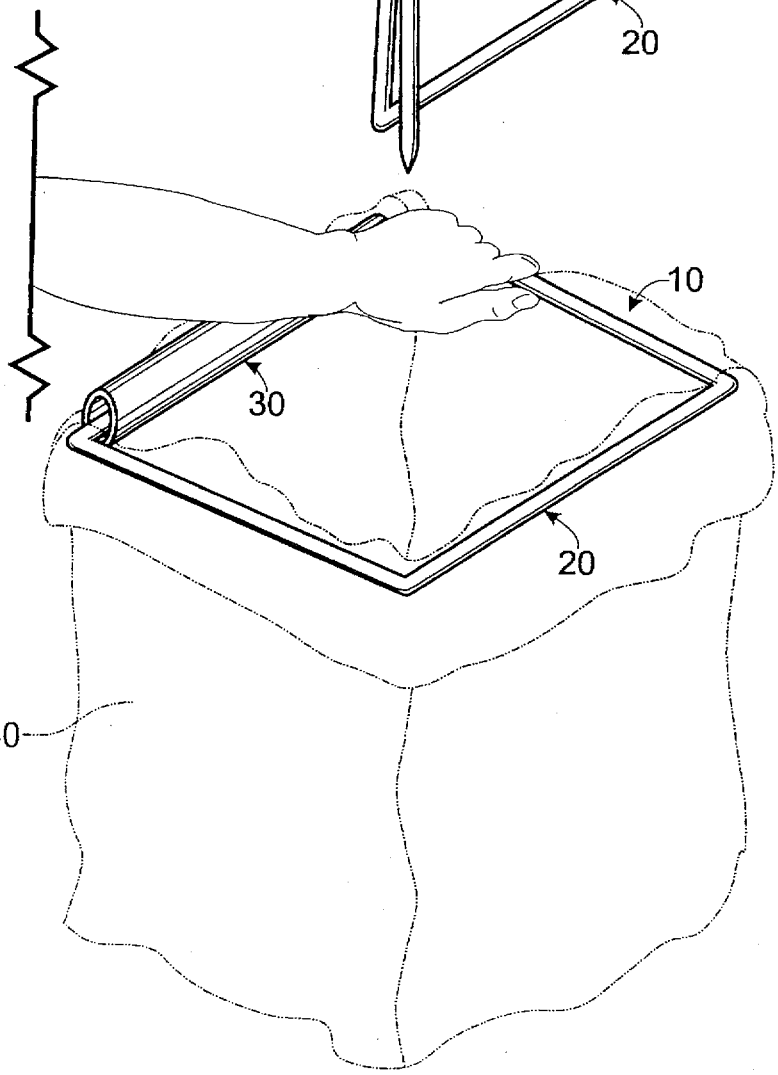

PORTABLE HOLDER FOR A REFUSE BAG

TECHNICAL FIELD

The present invention relates generally to a holder for carrying a refuse bag. More particularly, it concerns such a holder that can easily be carried about by a person who is seeking picking up, and bagging refuse or other things found on the ground.

BACKGROUND ART

Refuse bag holders of the type configured to receive a bag are well known. These holders typically are configured to support the bag in an open configuration, often by folding the lip of the bag over the holder's body so as to present an open mouth through which refuse may be received. Some bag holders have been provided with wheels for carting the holder and bag out to the curb for garbage pickup, or across a lawn for pick-up of lawn clippings, leaves, or other materials.

Although these devices work well in the intended environment of home and garden cleanup, they are ill-suited for use on the more varying terrain experienced by cleanup crews working along public highways. Such highways may be flanked by shoulders which are covered with vegetation, gravel; and/or dirt, and may be surrounded by terrain which slopes sharply up or down from the paved roadway. Due to this rough terrain, and due to the requirement that crews be transported with a minimum mount of equipment, crew members typically are sent out to gather refuse armed only with a bag, and perhaps a claw-tipped tool for picking up the refuse.

Supplying crew members with a conventional dolly or cart, however, is considered unwise due to the bulky and cumbersome nature of these devices. Accordingly, crew members typically are left holding the bag in one hand, while attempting to maneuver refuse through the bag's unspread mouth with the other hand. What is needed is a simple-to-construct, lightweight device for carrying and holding open a bag which will occupy a minimum amount of space when not in use.

DISCLOSURE OF THE INVENTION

The invented portable holder is made of lightweight rods and tubes combined to form a simple circumference for carrying and holding open a bag. The holder may include a two-legged stand which can be anchored in the ground with the bag's mouth disposed roughly vertically to permit easy tossing or sweeping of refuse through the open mouth. The legs of this stand also can be configured to provide sled runners which permit dragging the holder behind the user as he or she walks from one refuse collection site to another.

One appreciable advantage of the invented holder is the relatively low cost of its construction, particularly when compared to the relatively complicated devices known in the art. It will be understood, for example, that known devices typically are made of metal tubes which are interconnected by a series of nuts and bolts. The invented holder can be made quite simply using a bent aluminum rod combined with an ordinary polyvinyl chloride (PVC) pipe. The invented holder also is lightweight, owing in part to the lightweight nature of the aluminum and PVC construction which is preferred.

Another advantage comes from the modular structure of the holder, which provides for easy disassembly of the holder, and which makes it easy to transport. This modular arrangement also accommodates use of sled runners which permit dragging the refuse bag while in an open configuration. Alternatively, the holder may be constructed with legs which may be used to anchor the bag holder in the ground These and additional objects and advantages of the present invention will be more readily understood after a consideration of the drawings and the detailed description of the preferred embodiment.

BRIEF DESCRIPTION OF THE DRAWINGS

FIG. 1 is an isometric view of a refuse bag holder constructed in accordance with a preferred embodiment of the invention.

FIG. 2 is an isometric view demonstrating use of the refuse bag holder shown in FIG. 1.

FIG. 4 is an isometric view demonstrating collapsibility of the refuse bag holder shown in FIG. 3.

DETAILED DESCRIPTION OF THE PREFERRED EMBODIMENT AND BEST MODE OF THE INVENTION

Figure 3:
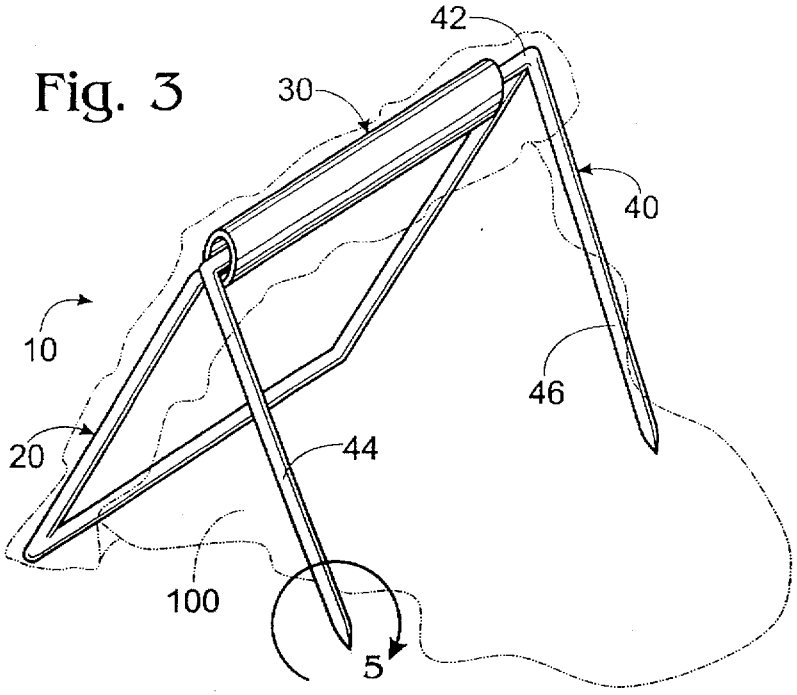
FIG. 3 is an isometric view of a refuse bag holder similar to that of FIG. 1, but including a support structure in the form of a two-legged stand.

Referring initially to FIGS. 1 and 2, it will be noted that a refuse bag holder is shown generally at 10. As indicated, the depicted holder includes an elongate rod 20 and a hollow tube 30, the rod and tube being combined to form a rigid perimeter structure for use in carrying a refuse bag. The perimeter structure thus is configured to receive a refuse bag 100 such that the mouth of the bag will be held in an open configuration.

In the depicted embodiment, rod 20 is bent to a generally C-shaped configuration, the resultant rod including an elongate central section 22 and a pair of elongate side sections 24, 26. Each side section is bent to a generally L-shaped configuration, and terminates in a terminal end 24*a*, 26*a*. The terminal ends are configured to face one another so as to provide for insertion thereof into opposite ends of the hollow robe. The rod thus will be seen to define a plurality of bends which give the rod its characteristic "C" shape.

As indicated in FIG. 1, rod 20 is somewhat resilient, allowing for selected deflection of the side sections to accommodate placement of the rod's terminal ends into corresponding open ends of the tube. The rod also typically is formed from a lightweight material (e.g. aluminum) which is easy to bend to the desired rod shape. Furthermore, the rod may be textured to enhance grippability of the rod.

Focusing now on tube 30, it will be noted that such tube includes an elongate hollow body 32 with opposite open ends 34, 36. The tube's open ends are sized to provide for receipt of the rod's terminal ends, and may further provide for receipt of a stand or sled assembly as described below. In the preferred embodiment, the tube is generally cylindrical, but may take on a variety of alternative forms. Furthermore, the tube need not be entirely hollow, it being possible to provide the desired assembly characteristics using a tube which is hollow only at its opposite ends. Tube 30 typically is formed of a relatively lightweight material such as polyvinyl chloride (PVC), and may be textured to enhance grippability of the tube.

FIG. 2 shows a refuse bag 100 mounted on the holder's perimeter structure, the bag's lip being folded over such structure to keep the bag in place. The shape of the perimeter structure (a rectangle in the depicted embodiment) defines the shape of the bag's open mouth. Accordingly, by gripping the perimeter structure, a user is able to hold the bag open with a single hand. The user can then carry the bag in one hand, while collecting refuse with the other hand. The user may grip the perimeter structure as indicated in FIG. 2, may grip the perimeter structure as indicated in FIG. 4, or may grip the perimeter structure at virtually any other point.

The aforementioned perimeter structure facilitates collection of refuse, but also provides the hub for a variety of other refuse bag holders, some of which include a support structure configured to keep the refuse bag in place. For example, FIG. 3 shows a refuse bag holder which includes both a perimeter structure and a support structure in the form of a two-legged stand 40. The stand is defined by a U-shaped rod having an elongate connector section 42, and a pair of elongate, generally parallel leg sections 44, 46. The connector section extends through tube 30. The leg sections project from opposite sides of the connector section to support the bag holder on the ground.

Figure 5:
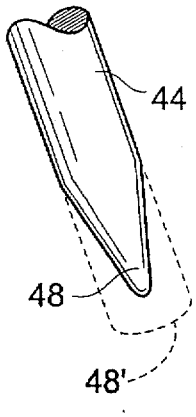
FIG. 5 is an enlarged isometric view illustrating alternative embodiments of the two-legged stand employed by the refuse bag holder of FIG. 3.

In the depicted embodiment, the leg sections include pointed ends 48 which define stakes configured to pierce the ground, thus keeping the bag holder in place (FIG. 5). It will be understood, however, that legs may be provided with blunt ends 48' which simply engage the ground. Furthermore, the legs of stand 40 may be configured to diverge so as to provide enhanced stability to the holder. In any event, the bag holder may be supported in a predetermined refuse-collecting orientation (FIG. 3).

Collapsibility of the refuse bag holder is demonstrated in FIG. 4, which shows the refuse bag holder with its support structure pivoted to a storage orientation. As indicated, C-shaped rod 20 and U-shaped rod 40 are folded together, giving the holder a relatively narrow profile. This configuration also may be employed when carrying a bag with one hand.

Figure 6:
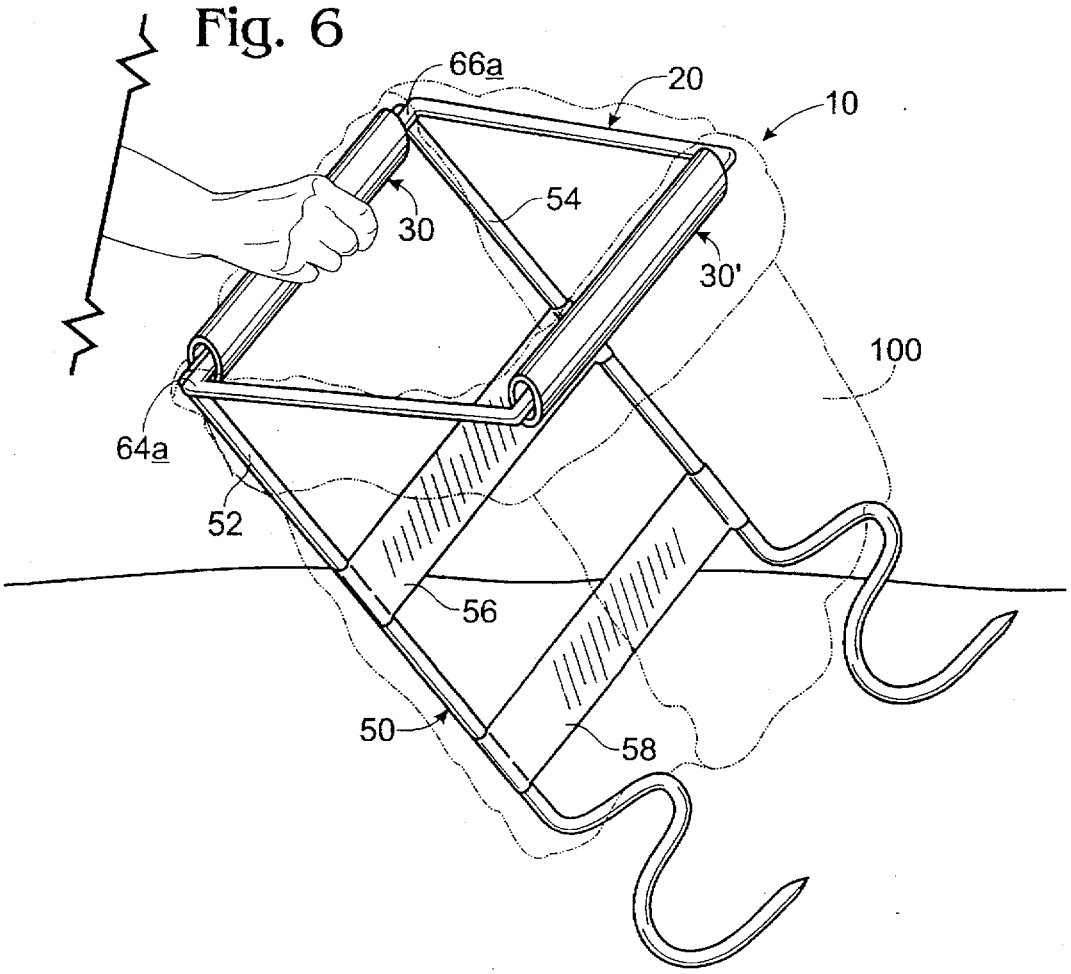
FIG. 6 is an isometric view of a refuse bag holder similar to that of FIG. 1, but including a ground-travel-transport mechanism in the form of a sled.

FIG. 6 shows a refuse bag holder which includes a support structure in the form of a sled 50 having a pair of elongate sled runners 52, 54. The sled runners preferably are defined by elongate rods having L-shaped end portions 64*a*, 66*a* which secure to the perimeter structure by insertion thereof into opposite open ends of perimeter structure tube 30 (or alternatively, into opposite ends of tube 30'). The depicted holder again may be gripped virtually anywhere along its perimeter structure, but preferably is gripped along tube 30 or 30' depending on whether the holder is to be carried or dragged.

Figure 10:
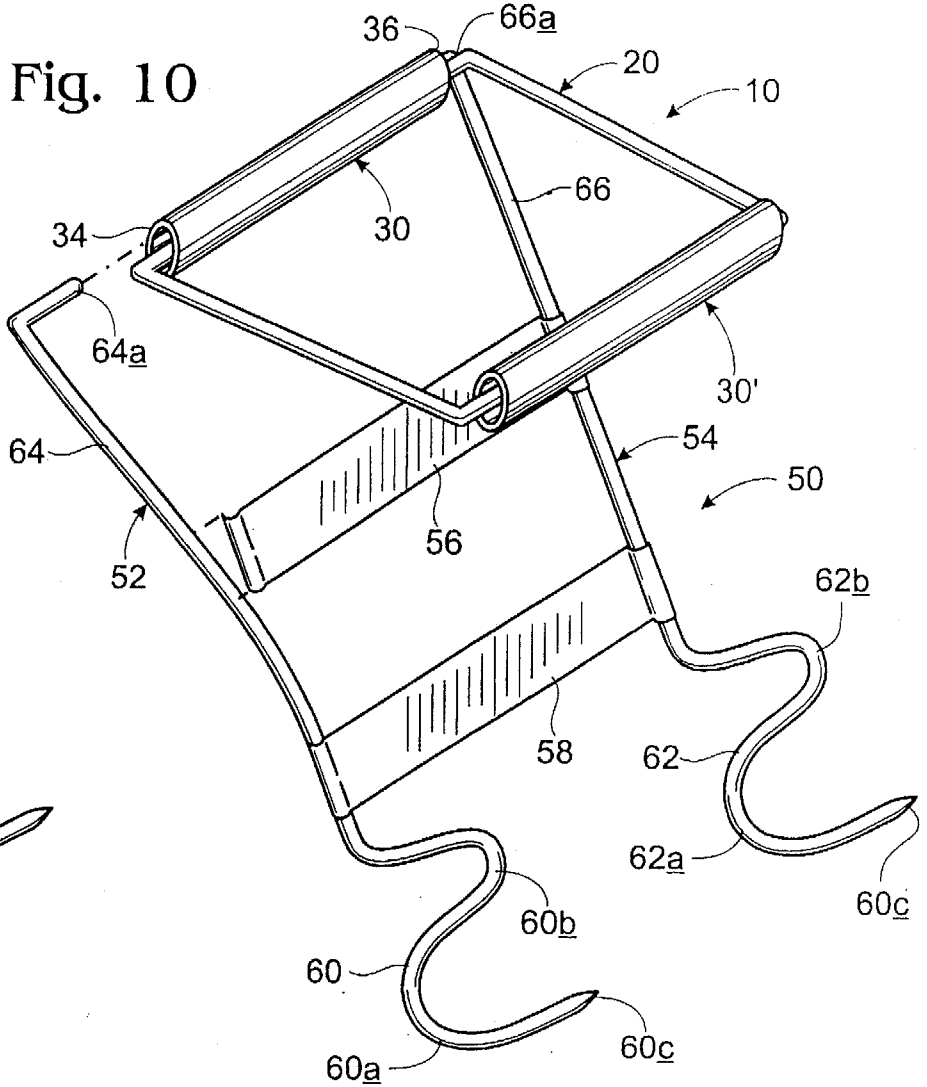
FIG. 10 is an isometric view demonstrating disassembly of the refuse bag holder shown in FIG. 6.

In the depicted embodiment, the sled runners are secured to the perimeter structure by cross-braces 56, 58, each of which pulls the sled runners together so as to grip the tube. The cross-braces may be of similar size, as indicated, or may be of different sizes to accommodate different support schemes. It will be understood, for example, that brace 58 may be wider than brace 56 so that it may better support the bottom of a bag. Upon removing cross-brace 56, the user is able to deflect the sled runner in a manner which removes it from the perimeter structure s tube (FIG. 10). Accordingly, the bag holder may be disassembled for shipping, storage, or the like.

Sled runners 52, 54 typically are made of a resilient material which accommodates disassembly of the sled as described above. Preferably, a lightweight material such as aluminum is chosen, but other materials (e.g. plastic) may be employed. The cross-braces typically are made of a similar material, but are sufficiently stiff to provide support for a carried bag. The cross-braces also hold the sled together, preferably by drawing the sled runners toward one another to maintain their relationship with the perimeter structure tube.

Figure 7:
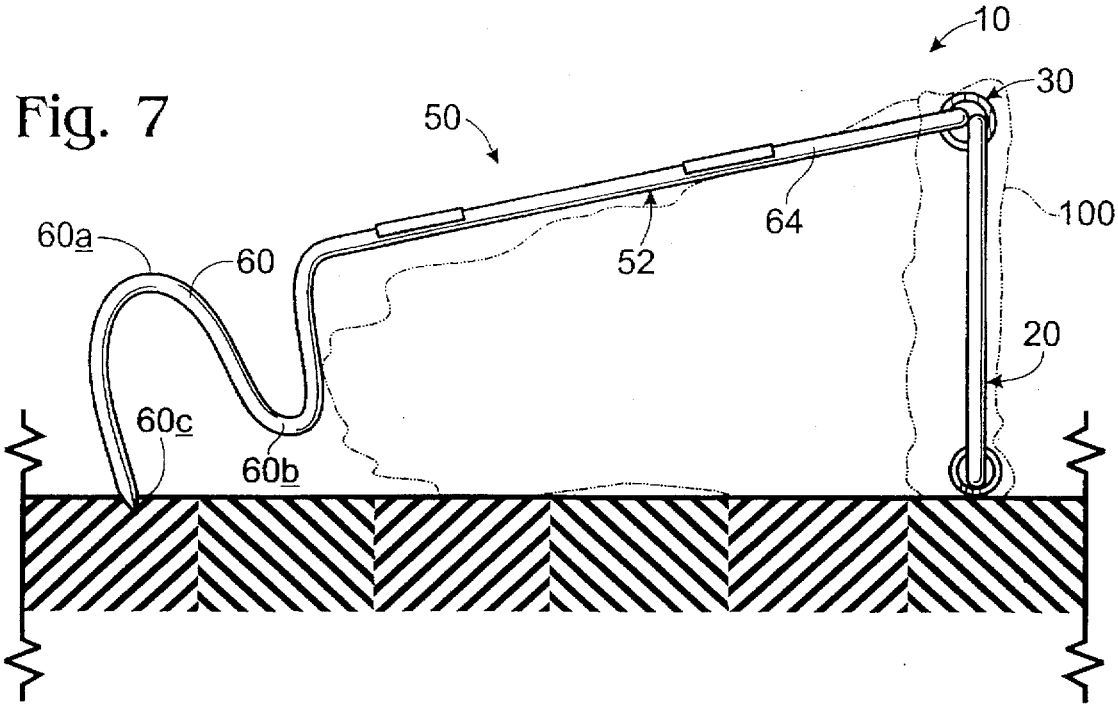
FIG. 7 is a left-side elevational view of the refuse bag holder of FIG. 6 in a debris-loading orientation.
Figure 9:
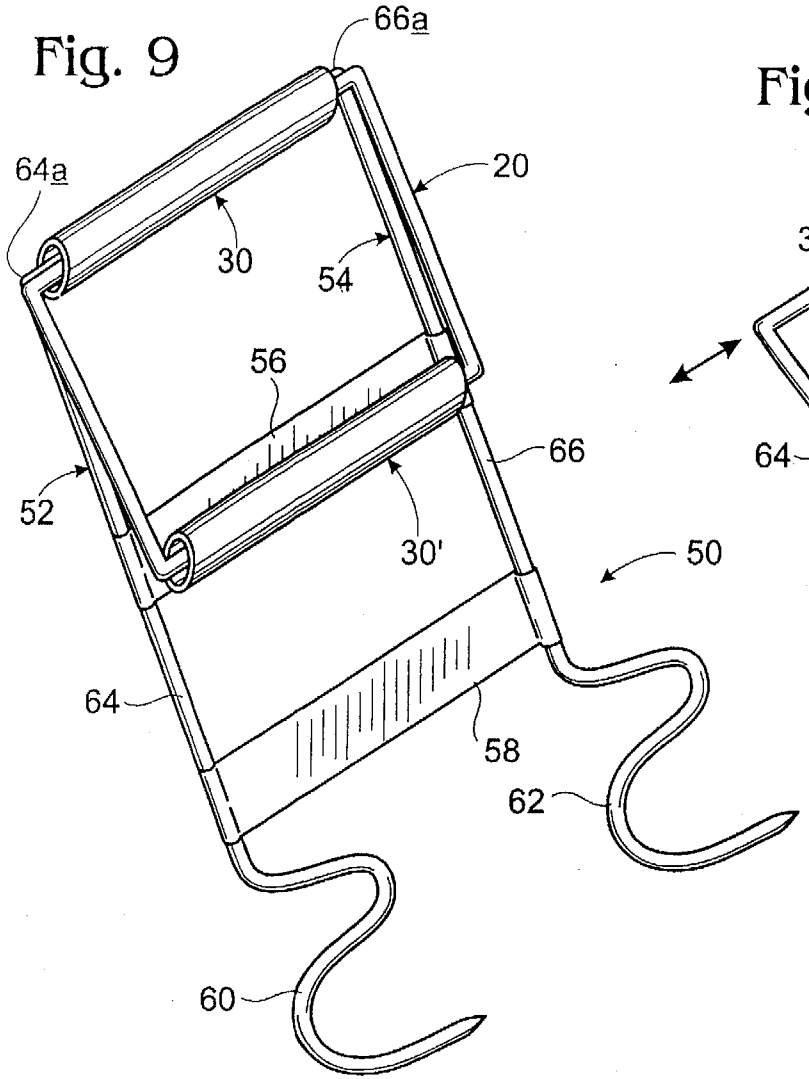
FIG. 9 is an isometric view demonstrating collapsibility of the refuse bag holder shown in FIG. 6.

As shown in FIGS. 7, 9, and 10, the sled runners include an undulated skid portions 60, 62 which typically provide ground-travel transport mechanism for the holder, and which may provide additional support for the bag. In the depicted embodiment, the skid portions contact the ground along first bends 60*a*, 62*a*. The bag is supported by second bends 60*b*, 62*b*, frame portions 64, 66, and associated cross-braces 56, 58. Because the skid portions are undulated, and because they are resilient, they also may act as shock absorbers, making the holder more convenient to the user and decreasing the likelihood of spill. The smooth curvature of the skid portions 60, 62, as shown in FIG. 6, also is preferred for dragging the holder with a minimum amount of ground friction.

Figure 8:
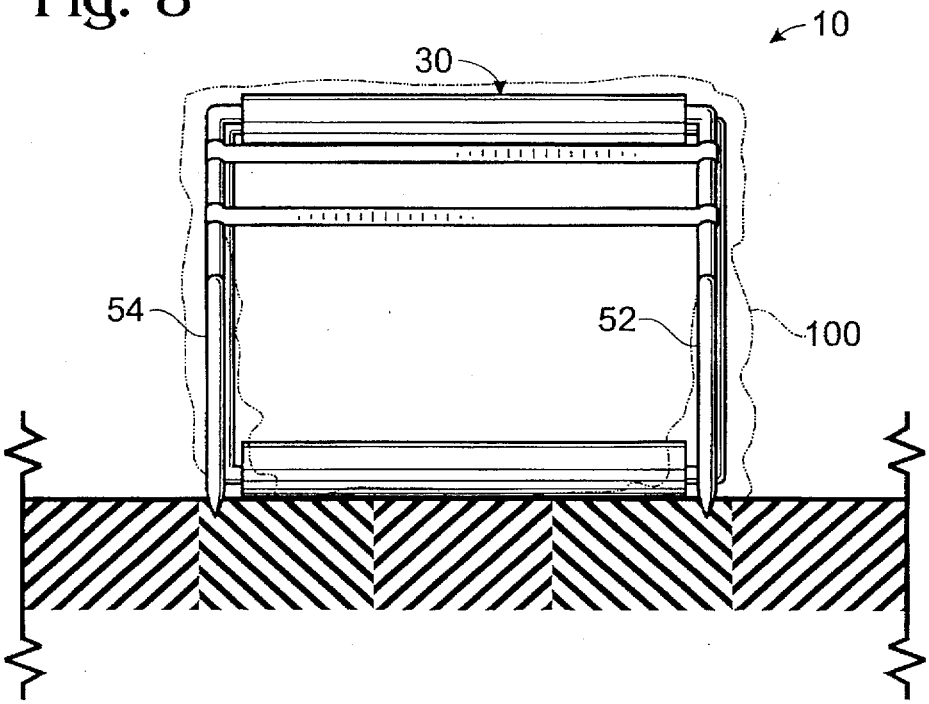
FIG. 8 is a rear elevational view of the refuse bag holder of FIG. 6, the refuse bag holder being shown the debris-loading orientation of FIG. 7.

In the depicted embodiment, the skid portions culminate in spiked ends 60*c*, 62*c*. similar to those shown in FIG. 5. This permits easy anchoring of the holder when it is turned over to support sweeping and raking operations as shown in FIGS. 7 and 8. In this configuration, the mouth of the bag is advantageously held in a nearly vertical position. Of course, the spiked ends also aid in anchoring the bag in steep terrain.

The compact size of the portable holder may be appreciated by reference to FIG. 9 where the sled is shown with the perimeter structure folded against the sled. Furthermore, the cross-braces 56, 58 may be configured to permit selected disassembly of the sled, at least one of the support braces being removably secured to a sled runner as shown in FIG. 10. The frame portions thus may be flexed to remove the frame portions' terminal ends 64*a*, 66*a* from the perimeter tube.

Accordingly, while the preferred embodiment of the invention has been described, it will be appreciated that variations may be made without departing from the spirit and scope of the invention.

I claim:

1. A holder for a holding a refuse bag, the holder comprising:

a tube having opposite first and second openings;

a C-shaped rod having facing first and second ends, the ends being deflectable and removably inserted into the openings in said tube, whereby said tube and said rod form a perimeter structure, and the bag can be inserted into, folded over, and held by the perimeter structure formed by said rod and said tube; and a U-shaped rod having a middle portion and a pair of oppositely-extending legs, said middle portion being captured within said tube along with said facing first and second ends of said C-shaped rod.

2. The holder of claim 1 wherein said rod is constructed of lightweight aluminum.

3. The holder of claim 1 wherein said tube is constructed of polyvinyl chloride.

4. The holder of claim 1 wherein said U-shaped rod is constructed of lightweight aluminum.

5. The holder of claim 1 wherein said legs of said U-shaped rod have spiked ends.

6. A holder for a holding a refuse bag, the holder comprising:

a tube having opposite first and second openings;

a C-shaped rod having facing first and second ends, the ends being deflectable and removably inserted into the openings in said tube, whereby said tube and said rod form a perimeter structure, and the bag can be inserted into, folded over, and held by the perimeter structure formed by said rod and said tube; and two sled runners, each having a frame portion with a tube connection end which is insertable into opposite openings of said tube along with said first and second ends of said C-shaped rod.

7. The holder of claim 6 wherein each of the sled runner includes a skid portion configured to support the sled runners.

8. The holder of claim 7 further comprising a cross-brace interconnecting said frame portions of said sled runners.

9. The holder of claim 8 wherein said cross-brace is removably connected to at least one of said frame portions of said sled runners.

10. The holder of claim 7 wherein said skid portions define shock absorbers for said sled runners.

11. The holder of claim 6 wherein each of said sled runners includes a spiked end whereby the sled runners may be anchored in the ground.

12. The holder of claim 6 wherein said sled runners are constructed of lightweight aluminum.

13. A holder for use in supporting a refuse bag for transport along the ground, the holder comprising:

an elongate sled connector tube having openings in opposite tube ends;

a rod having a central section and a pair of legs extending from the central section, each leg having a terminal end configured for capture in one of said openings in said sled connector tube, whereby said rod and tube form a perimeter structure configured for receipt of the refuse bag, the bag being folded over the perimeter structure to hold the bag in place; and a pair of sled runners, each having an undulated skid portion and a frame portion coupled to the skid portion, each frame portion having a terminal end configured for capture within the openings of said sled connector tube along with said terminal ends of said legs, the bag being supported from below as the holder is transported by dragging the skid portion along the ground.

14. The holder of claim 13 wherein each of said sled runners includes a spiked end whereby the sled can be anchored in the ground.

15. The holder of claim 13, which further comprises a cross-brace configured to interconnect the frame portions of said sled runners.

16. The holder of claim 15 wherein the cross-brace is removably connected to at least one of the frame portions of said sled runners.

17. The sled of claim 13 wherein each of the undulated skid portions define a shock absorber.

* * * * *